US005382374A

United States Patent [19]

Takemitsu et al.

[11] Patent Number: 5,382,374

[45] Date of Patent: Jan. 17, 1995

[54] HYDRAULIC FLUIDS FOR AUTOMOBILE SUSPENSIONS

[75] Inventors: Koji Takemitsu, Saitama; Kenyu Akiyama, Toyota; Hiroshi Ohashi, Sakado; Syoichi Ichikawa, Nagoya, all of Japan

[73] Assignees: Tonen Corporation, Tokyo; Toyota Jidosha Kabushiki Kaisha, Aichi, both of Japan

[21] Appl. No.: 26,226

[22] Filed: Feb. 26, 1993

Related U.S. Application Data

[63] Continuation of Ser. No. 675,768, Mar. 27, 1991, abandoned.

[30] Foreign Application Priority Data

Mar. 31, 1990 [JP] Japan ..... 2-82927
Feb. 18, 1992 [JP] Japan ..... 3-078683

[51] Int. Cl.[6] ..... C10M 105/02; C10M 105/74; C10M 141/10

[52] U.S. Cl. ..... 252/73; 252/32.5; 252/49.8; 252/56 S; 252/56 D; 252/77; 252/78.1; 252/78.5; 252/79

[58] Field of Search ..... 252/32.5, 56 S, 56 D, 252/49.8, 49.9, 78.5, 78.1, 79, 77, 73; 585/10

[56] References Cited

U.S. PATENT DOCUMENTS 3,728,260 4/1973 Flowerday et al. ..... 252/32.5
3,785,975 1/1974 Humphrey et al. ..... 252/32.5
3,793,199 2/1974 Schlicht ..... 252/32.5
4,036,767 7/1977 Yamamoto ..... 252/51.5 A
4,036,768 7/1977 Crawford ..... 252/51.5 A
4,209,414 6/1980 Holgado et al. ..... 252/49.6
4,215,002 7/1980 Fein ..... 252/32.5
4,402,841 9/1983 Schieman ..... 252/51.5 R
4,462,920 7/1984 Snyder et al. .
4,507,215 3/1985 Schroeck ..... 252/46.7
4,519,932 5/1985 Schnur et al. ..... 252/56 S
4,521,321 6/1985 Anderson et al. ..... 252/32.5
4,719,025 1/1988 Akiyama et al. ..... 252/56 S
4,965,002 10/1990 Brannen et al. ..... 252/32.5

FOREIGN PATENT DOCUMENTS 127484 2/1977 Japan .
9497 1/1986 Japan .
32188 2/1987 Japan .
79299 3/1989 Japan .

*Primary Examiner*—Margaret Medley
*Attorney, Agent, or Firm*—Lowe, Price, LeBlanc & Becker

[57] ABSTRACT

Hydraulic fluids for automobile suspensions are described. They contain, as a base oil, a mixed oil which in turn contains 70–90 wt. % of an olefin oligomer and 10–30 wt. % of a diester obtained by condensation of an aliphatic dibasic acid having 4–14 carbon atoms and an alcohol having 4–14 carbon atoms. The hydraulic fluids also comprise a phosphate ester friction modifier to improve the friction characteristics and antiwear characteristics in an initial stage and at least one friction modifier selected from the group consisting of phosphite esters and phosphoric ester amine salts to retain low friction characteristics over a long period of time.

8 Claims, No Drawings

HYDRAULIC FLUIDS FOR AUTOMOBILE SUSPENSIONS

This application is a continuation of application Ser. No. 07/675,768 filed Mar. 27, 1991, now abandoned.

FIELD OF THE INVENTION

The present invention relates to hydraulic fluids for automobile suspensions, and especially to hydraulic fluids which are suitable for use in hydraulic power units adapted to perform leveling control of automobiles by using a hydraulic oil and have such excellent hydraulic response characteristics as permitting accurate leveling control. More specifically, the present invention is concerned with hydraulic fluids for automobile suspensions, said fluids comprising as a base oil a mixed oil of an olefin oligomer and a diester and hence being of the synthetic lubricating oil base and having excellent hydraulic response characteristics.

BACKGROUND OF THE INVENTION

Suspensions for automobile bodies include those having hydraulic rams arranged near respective wheels instead of spring dampers whereby the rams are driven by hydraulic pressure from a pressure accumulator to stably control the spatial orientation of the automobile bodies; in other words, to perform stable leveling control of the automobile bodies. Hydraulic fluids for suspensions of the above type are required to have as their basic properties desirable viscosity at high temperatures and preferable fluidity at low temperatures, namely, good viscosity-temperature characteristics in view of the severe use environments of automobiles.

Known conventional hydraulic fluids for automobile suspensions include those containing as a base oil a low-viscosity mineral oil having excellent low-temperature fluidity and as a viscosity index improver a large amount of polymethacrylate (PMA) to impart desired viscosity-temperature characteristics. Although such conventional hydraulic fluids based on mineral oil have good viscosity-temperature characteristics, they are insufficient in those other characteristics required.

In the conventional hydraulic fluids based on mineral oil, a mineral oil having a kinematic viscosity of about 2 $mm^2/s$ (=cSt) at 100° C. is used as a base oil and a large amount of PMA is added as a viscosity index improver to impart desired viscosity-temperature characteristics, so that the viscosity at 100° C. is adjusted to about 6 $mm^2/s$ or so. These hydraulic fluids have such problems as will be described below.

(1) In contrast to ordinary hydraulic fluids for automobiles—for example, ATF (automatic transmission fluid) and PSF (power steering fluid) which have a flash point of at least 200° C.—the flash points of the above-described hydraulic fluids are very low, i.e., 100°–140° C.

(2) Evaporation loss from ATF or PSF is practically 0%, whereas hydraulic fluids have an evaporation loss as high as 15–35%.

(3) Anti-seizure property is low because of the low viscosity of the base oil.

(4) Hydraulic fluids undergo significant viscosity reduction by shear force, so that their shear stability is poor. This means that hydraulic fluids are reduced in viscosity by shear force generated by the sliding parts of piston pumps or in the nozzles of shock absorber pistons. This viscosity reduction can be attributed primarily to the low shear stability of PMA.

As has been described above, it is extremely difficult for conventional mineral-oil-based hydraulic fluids to satisfy the various characteristics required for hydraulic fluids for automobile suspensions, in particular, to stably maintain good hydraulic response characteristics over a long period of time.

OBJECTS AND SUMMARY OF THE INVENTION

An object of the present invention is to provide a hydraulic fluids for automobile suspensions, which has good viscosity-temperature characteristics, improved inflammability, evaporation resistance, anti-seizure property, shear stability and the like and retains good hydraulic response over a long period of time.

The present inventors have proceeded with an intensive investigation to overcome the above-described problems of the conventional techniques. As a result, it was found that the above objects can be attained by using, as a base oil, a synthetic lubrication oil which has been obtained by mixing an olefin oligomer and a diester at a particular ratio, leading to the completion of the present invention.

According to one aspect of the present invention, there is thus provided a hydraulic fluid for automobile suspensions, which comprises, as a base oil, a mixed oil which in turn comprises (a) 70–90 wt. % of an olefin oligomer and (b) 10–30 wt. % of a diester obtained by condensation of an aliphatic dibasic acid having 4–14 carbon atoms and an alcohol having 4–14 carbon atoms.

According to another aspect of the present invention, there is also provided a hydraulic fluids for automobile suspensions, which comprises the above base oil, a phosphoric ester friction modifier and a viscosity index improver.

DETAILED DESCRIPTION OF THE INVENTION

Features of the present invention will hereinafter be described in detail.

The hydraulic fluids for automobile suspensions—which pertains to the present invention—is used, as described above, in hydraulic units adapted to perform leveling control of a vehicle body by using hydraulic pressure rather than the conventional suspension system that uses spring dampers. In a leveling control method of this type, information on road surface conditions is obtained at a rate of several thousands/second, for example, 3,000 pieces/second by means of sensors, and leveling control is performed in accordance with the information. To achieve accurate leveling control, it is therefore indispensable to use a hydraulic fluids which can stably respond to instructions of actuation of the hydraulic units, said instructions being given at often as several thousands per second, over a long period of time.

According to the present inventors' investigation, a hydraulic fluid which is employed as a suspension oil for applications of the above-described kind desirably has, in view of the environmental conditions of use of automobiles, good high-temperature viscosity characteristics, specifically a kinematic viscosity of usually 2–15 $mm^2/s$, preferably 4–10 $mm^2/s$ at 100° C. and good low-temperature viscosity characteristics (low-temperature fluidity), particularly a viscosity of normally 400–2,400 mPa.s, preferably 500–2,000 mPa.s at −40°

C. It is also desirable that the hydraulic fluid has a viscosity index (V.I.) of normally at least 200, preferably at least 250. Further, as fundamental characteristics of hydraulic fluids for suspensions, the hydraulic fluid must be excellent in inflammability resistance, evaporation resistance, anti-seizure property, shear stability and the like.

Hydraulic fluids excellent in such various properties can be provided by using, as a base oil, a mixed oil which contains (a) 70–90 wt. % of an olefin oligomer and (b) 10–30 wt. % of a diester obtained by condensation of an aliphatic dibasic acid having 4–14 carbon atoms and an alcohol having 4–14 carbon atoms.

Olefin Oligomer

The olefin oligomer employed in the present invention is obtained by homopolymerization of a desired olefinic hydrocarbon or copolymerization of desired two or more olefinic hydrocarbons selected from linear or branched olefinic hydrocarbons having usually 2–14 carbon atoms, preferably 4–12 carbon atoms.

The olefin oligomer has a kinematic viscosity of usually 1–130 $mm^2/s$, preferably 1.5–25 $mm^2/s$ at 100° C. Its average molecular weight is usually in the range of from about 100 to about 2,000, preferably in the range of from about 200 to about 1,000. As olefin oligomers for use in the present invention, olefin oligomers whose unsaturated bonds have been saturated by hydrogenation are particularly preferred.

Illustrative olefin oligomers include α-olefin oligomers, ethylene/e-olefin oligomers, and the like. Examples of the α-olefin oligomers include mixtures of α-olefin oligomers having 6–12 carbon atoms, said mixtures being available by trimerization to hexamerization of hydrocarbons or lower olefins, for example, that obtained by copolymerization of a mixture consisting of 25–50 wt. % of hexene-1, 30–40 wt. % of octene-1 and 25–40 wt. % of decene-1. Olefin oligomers available from the single use of monomers such as decene-1 and hydrogenation products thereof are also suitable. Examples of the ethylene/α-olefin oligomers include that obtained by copolymerization of 40–90 wt. % of ethylene and 10–60 wt. % of propylene.

These olefin oligomers can be produced using, as a catalyst, a Friedel-Crafts catalyst such as aluminum chloride or boron fluoride, a Ziegler catalyst, an oxide catalyst such as chromium oxide, or the like. Hydrogenation of an olefin oligomer can be conducted by bringing a polymerization reaction product into contact with hydrogen in the presence of a hydrogenation catalyst, for example, nickel-molybdenum/alumina under elevated temperature and pressure.

Diester

The diester employed in the present invention is a diester obtained by dehydrating condensation of an aliphatic dibasic acid having 4–14 carbon atoms and an alcohol having 4–14 carbon atoms. The diester generally has a kinematic viscosity of 2–7 $mm^2/s$ at 100° C.

Illustrative aliphatic dibasic acids having 4–14 carbon atoms include succinic acid, glutaric acid, adipic acid, piperic acid, suberic acid, azelaic acid, sebacic acid, undecanedioic acid, dodecanedioic acid, brassilic acid and tetradecanedioic acid. Among these, adipic acid, azelaic acid and sebacic acid, with adipic acid and sebacic acid being particularly preferred.

Examples of the alcohols having 4–14 carbon atoms include n-butanol, isobutanol, n-amyl alcohol, isoamyl alcohol, n-hexanol, 2-ethylbutanol, cyclohexanol, n-heptanol, isoheptanol, methylcyclohexanol, n-octanol, dimethylhexanol, 2-ethylhexanol, 2,4,4-trimethylpentanol, isooctanol, 3,5,5-trimethylhexanol, isononanol, isodecanol, isoundecanol, 2-butyloctanol, tridecanol and isotetradecanol. Of these, 2-ethylhexanol and isodecanol are particularly preferred.

Diesters which can be obtained from these aliphatic dibasic acids and alcohols include, for example, di(1-ethylpropyl) adipate, di(3-methylbutyl) adipate, di(1,3-methylbutyl) adipate, di(2-ethylhexyl) adipate, di(isononyl) adipate, di(isodecyl) adipate, di(undecyl) adipate, di(tridecyl) adipate, di(isotetradecyl) adipate, di(2,2,4-trimethylpentyl) adipate, di[mixed (2-ethylhexyl, isononyl)] adipate, di(1-ethylpropyl) azelate, di(3-methylbutyl) azelate, di(2-ethylbutyl) azelate, di(2-ethylhexyl) azelate, di(isooctyl) azelate, di(isononyl) azelate, di(isodecyl) azelate, di(tridecyl) azelate, di[mixed (2-ethylhexyl, isononyl)] azelate, di[mixed (2-ethylhexyl, decyl) azelate, di[mixed (2-ethylhexyl, isodecyl)] azelate, di[mixed (2-ethylhexyl, 2-propylheptyl)] azelate, di(n-butyl) sebacate, di(isobutyl) sebacate, di(1-ethylpropyl) sebacate, di(1,3-methylbutyl) sebacate, di(2-methylbutyl) sebacate, di(2-ethylhexyl) sebacate, di[2-(2-ethylbutoxy)ethyl] sebacate, di(2,2,4-trimethylbenzyl) sebacate, di(isononyl) sebacate, di(isodecyl) sebacate, di(isoundecyl) sebacate, di(tridecyl) sebacate, di(isotetradecyl) sebacate, di[mixed (2-ethylhexyl, isononyl)] sebacate, di(2-ethylhexyl) glutarate, di(isoundecyl) glutarate, and di(isotetradecyl) glutarate.

These diesters have a kinematic viscosity of usually 2–7 $mm^2/s$, preferably 2.2–6 $mm^2/s$ at 100° C. An unduly low kinematic viscosity poses problems on inflammability, evaporation and load carrying capacity, whereas an unduly high kinematic viscosity results in a high viscosity at low temperatures and hence impairs low-temperature fluidity.

Base Oil

The base oil of the hydraulic fluid according to the present invention, which is suitable for use in automobile suspensions, contains a mixed oil of the olefin oligomer and diester described above.

Regarding their mixing ratio, the proportion of the olefin oligomer is 70–90 wt. %, preferably 75–90 wt. %, more preferably 80–85 wt. % while the proportion of the diester is 10–30 wt % preferably 10–25 wt. %, more preferably 15–20 wt. %. Use of the mixed oil of the above mixing ratio as a base oil makes it possible to satisfy the above-described characteristics required for hydraulic fluids for automobile suspensions, namely, to provide a hydraulic fluid having good viscosity-temperature characteristics and improved in inflammability, evaporation, anti-seizure property, shear stability and the like. In the conventional hydraulic fluids which contain mineral oil as a base oil, improvements in viscosity-temperature characteristics result in deterioration in evaporation resistance, shear stability, and the like. The base oil useful in the practice of the present invention can however achieve good evaporation resistance and shear stability while improving the viscosity-temperature characteristics too.

An unduly high proportion of the diester in the base oil leads to an increase in low-temperature viscosity and a decrease in low-temperature fluidity and further results in the tendency to cause swelling of rubber members of hydraulic units. On the other hand, an excessively high proportion of the olefin oligomer tends to harden such rubber members.

The base oil employed in the present invention may be added with one or more other lubricating oils such as mineral oil. For example, the hydraulic fluid of the present invention for use in automobile suspensions may retain good low-temperature viscosity characteristics at −40° C. even when a mineral-oil-based hydraulic fluid is added in a proportion lower than 50 wt. %.

Additives

To improve the properties as a hydraulic fluid for automobile suspensions, the present invention permits addition of various additives to the base oil which contains the mixed oil of the olefin oligomer and the diester. Among these additives, particularly preferred are a phosphoric ester friction modifier and a viscosity index improver.

Phosphoric Ester Friction Modifier

To improve the friction characteristics and antiwear characteristics, the hydraulic fluid of this invention for use in suspensions can be added with at least one friction modifier selected from phosphate esters, phosphite esters and amine salts thereof, especially phosphate ester amine salts.

Phosphate esters are used to improve the friction characteristics and antiwear characteristics especially in an initial stage, namely, during the running-in period, while phosphite esters are employed to retain low friction characteristics over a long period of time especially after the running-in period. Phosphate ester amine salts have similar properties to phosphite esters and can retain good friction characteristics over a still longer period than the phosphite esters although their friction characteristics are somewhat higher than the phosphite esters.

Examples of the phosphate ester and phosphite ester include those represented by the following formulate:

$O{=}P(OR_1)(OR_2)(OR_3)$,
$O{=}P(OH)(OR_1)(OR_2)$,
$O{=}P(OH)_2(OR_1)$,
$P(OR_1)(OR_2)(OR_3)$,
$P(OH)(OR_1)(OR_2)$,
$P(OH)_2(OR_1)$.

wherein $R_1$, $R_2$ and $R_3$ are the same or different and are independently a saturated or unsaturated alkyl group having at least 4 carbon atoms, an aryl group or an alkyl-substituted aryl group.

More specific examples of phosphoric ester friction modifiers include oleyl acid phosphate [mixture of $(C_{18}H_{35}O)P(OH)_2O$ and $(C_{18}H_{35}O)_2P(OH)O$] and dioleyl hydrogenphosphite [$(C_{18}H_{35}O)_2P(OH)$].

Phosphoric ester amine salts are reaction products of phosphate esters or phosphite esters and amine compounds. Examples of the amine compounds include primary or secondary amines which contain one or two saturated or unsaturated alkyl groups having 10–20 carbon atoms. Diisooctyl acid phosphate amine salt [reaction product of $(i\text{-}C_8H_{17}O)_2P(OH)O$ and $(C_{18}H_{35})NH_2$] can be mentioned as a specific example.

The mixing proportion of the phosphoric ester friction modifier may generally range from 0.01 wt. % to 5 wt. %, with the range of 0.05–2 wt. % being preferred. Within this range of mixing proportions, good friction characteristics and antiwear characteristics can be obtained. It is to be noted that combined use of two or more of these friction modifiers is preferred with a view toward retaining good friction characteristics and antiwear characteristics not only in an initial stage but also over a long period of time.

Viscosity Index Improver

Polymethacrylate (PMA) of a relatively high molecular weight has been incorporated as a viscosity index improver in conventional mineral-oil-base hydraulic fluids to obtain good viscosity-temperature characteristics. In contrast, the base oil employed in the present invention exhibits by itself good viscosity-temperature characteristics so that addition of PMA having a weight average molecular weight of about 20,000–200,000, preferably at least 20,000 but lower than 100,000, more preferably 30,000–90,000 can improve the viscosity-temperature characteristics of the hydraulic fluid further. In particular, PMA having a relatively low molecular weight lower than 100,000 has superior shear stability to PMA of a high molecular weight and can improve both the viscosity-temperature characteristics and shear stability of the hydraulic fluid of the present invention.

These viscosity index improvers can be added in a proportion of generally 5–30 wt. %, preferably 10–25 wt. %.

Besides the above-described PMA, other viscosity index improvers such as PIB (polyisobutylene), EPC (ethylene-propylene copolymer) and SPC. (hydrogenated products of styrene-butadiene copolymers) can also be used as long as good temperature-viscosity characteristics and shear stability are obtained similarly to the use of PMA.

Other Additives

In addition to the phosphoric ester friction modifier and viscosity index improver described above, one or more of additives commonly employed in lubrication oils, for example, ashless dispersants, metal deactivators, antioxidants, defoaming agents, rust preventives, metal detergents and the like can be added to the hydraulic fluid of the present invention for automobile suspensions to extents not impairing the objects of the present invention.

Ashless dispersants are used to disperse the phosphoric ester friction modifier, any deterioration products of the hydraulic fluid, etc. in the oil. Examples of the ashless dispersants include succinimide-, succinamide-, benzylamine- and ester-based, ashless dispersants. These ashless dispersants are used generally in a proportion of 0.05–1 wt. %.

Metal deactivators are employed to prevent corrosion of metals by any oxidation or thermal deterioration products of the oil or to avoid dissolution of metals into the base oil. They include, for example, thiadiazole-based and triazole-based metal deactivators. They can be used generally in a proportion of 0.01–0.5 wt. %

As the antioxidants, conventional antioxidants such as amine-based antioxidants and phenol-based antioxidants can be used. Illustrative amine-based antioxidants include alkylated diphenylamines, phenyl-α-naphthylamines and alkylated-α-naphthylamines, whereas examples of phenol-based antioxidants include 2,6-di-t-butylphenol and 4,4'-methylenebis(2,6-t-butylphenol). They can be used generally in a proportion of 0.05–1 wt. %.

As other additives, defoaming agents such as dimethyl polysiloxane and polyacrylates, rust preventives such as alkenyl succinates, their partial esters and alkanol amines, metal detergents such as compounds capable of neutralizing oxidation and other deterioration products of the oil—e.g., calcium sulfonates, magnesium sulfonates, barium sulfonates, calcium phenates and barium phenates—can be employed suitably as needed.

ADVANTAGES OF THE INVENTION

The hydraulic fluids for automobile suspensions according to the present invention, which comprise as a base oil a mixed oil containing an olefin oligomer and a diester, are excellent not only in viscosity-temperature characteristics but also in inflammability, evaporation resistance, anti-seizure property, shear stability and the like. The hydraulic fluids of the present invention are therefore extremely suited for use in hydraulic units adapted to perform leveling control of automobiles, and can exhibit outstanding hydraulic response over a long period of time.

EMBODIMENTS OF THE INVENTION

The present invention will hereinafter be described in further detail on the basis of the following examples. It is however to be noted that the present invention is not limited to or by the following examples.

EXAMPLES 1-18 & COMPARATIVE EXAMPLES 1-3

Hydraulic fluids for automobile suspensions were prepared by mixing the base oil components with their corresponding various additive components, both shown in Tables 1-4. The proportions of the individual components are shown by wt. %. Incidentally, the wt. % of each additive component is based on the total amount of its corresponding base oil components and additive components, including the first-mentioned additive component.

The individual components in the tables are as follows:

PA01: Hydrogenation product of a decene-1 oligomer. Kinematic viscosity: 2.3 $mm^2/s$ at 100° C.

PA02: Hydrogenation product of a decene-1 oligomer. Kinematic viscosity: 1.7 $mm^2/s$ at 100° C.

Diester: Di(2-ethylhexyl) adipate. Kinematic (DOA) viscosity: 2.3 $mm^2/s$ at 100° C.

Diester: Di(isodecyl) adipate. Kinematic (DiDA) viscosity: 3.6 $mm^2/s$ at 100° C.

Mineral oil: Kinematic viscosity: 2.0 $mm^2/s$ at 100° C.

Ash-free dispersant:
Alkenylsuccinic acid polyalkylene polyimide

Antioxidant A (phenol type)
2,6-Di-t-butyl-4-methylphenol.

Antioxidant B (amine type)
Bis(p-octylphenyl)amine.

Metal deactivator:
Benzotriazole-based metal deactivator.

Viscosity index improver:
Polymethacrylate (PMA).
1) Weight average molecular weight (Mw): 35,000.
2) Weight average molecular weight (Mw): 90,000.
3) Weight average molecular weight (Mw): at least 100,000.

Friction modifier (phosphate ester):
Mixture of monooleyl phosphate and dioleyl phosphate [mixture of $(C_{18}H_{35}O)P(OH)_2O$ and $(C_{18}H_{35}O)_2P(OH)O$].

Friction modifier (phosphite ester):
Dioleyl hydrogenphosphite $[C_{18}H_{35}O)_2P(OH)]$.

Friction modifier (phosphate ester amine salt)
Reaction product of $(i\text{-}C_8H_{17}O)_2P(OH)O$ and $(C_{18}H_{35})NH_2$.

<Performance evaluation methods>

Kinematic viscosity:
Measured at 100° C. in accordance with JIS (Japanese Industrial Standard) K-2283, using a Ubbelohde viscometer. Its unit is $mm^2/s$ (=cSt).

Viscosity index:
Calculated in accordance with JIS K-2283, from kinematic viscosities measured at 40° C. and 100° C. respectively, using a Ubbelohde viscometer. The greater the viscosity index, the better the viscosity-temperature characteristics.

Low-temperature viscosity:
Measured the viscosity at −40° C. in accordance with ASTM D-2983, using a Brookfield viscometer.

Evaporation loss:
Each hydraulic fluid sample was placed in a metal-made vessel and depressurized to $-20$ $mmH_2O$ by a vacuum pump. The oil sample was then heated at 100° C. for 8 hours. The amount of the evaporated oil sample was measured. The wt. % of the evaporated oil sample based on the weight before the heating was calculated.

Shear stability:
Each hydraulic fluid sample was placed in a glass-made vessel and was then exposed to 10 KHz ultrasonic waves for 30 minutes. The percentage of viscosity reduction after the test was measured.

Compatibility with nitrile rubber:
Sample pieces of nitrile rubber were immersed in each hydraulic fluid sample at 120° C. for predetermined periods of time (70, 140, 280, 560 hours), respectively. Variations in physical properties (volume, hardness, tensile strength and elongation) of the rubber were measured. The measurement results were judged in parallel, whereby the hydraulic fluid sample was rated "good" where the percent variations of the respective physical properties were small but "poor" where large percent variations were exhibited.

The results of the performance evaluation are summarized in Table 1 to Table 4.

TABLE I

| | (Composition, wt. %) | | | | | |
|---|---|---|---|---|---|---|
| | Example 1 | Example 2 | Example 3 | Comparative Example 1 | Comparative Example 2 | Comparative Example 3 |
| Base oil | | | | | | |
| PAO1 | 75 | 80 | 85 | — | — | 55 |
| PAO2 | — | — | — | — | — | — |
| Diester(DOA) | 25 | 20 | 15 | — | — | 45 |
| Mineral oil | — | — | — | 100 | 100 | — |
| Additive | | | | | | |
| Ashless dispersant | 0.2 | 0.2 | 0.2 | 0.2 | 0.2 | 0.2 |
| Antioxidant (phenol type) | 0.2 | 0.2 | 0.2 | 0.2 | 0.2 | 0.2 |
| Antioxidant (amine type) | 0.1 | 0.1 | 0.1 | 0.1 | 0.1 | 0.1 |
| Metal deactivator | 0.05 | 0.05 | 0.05 | 0.05 | 0.05 | 0.05 |
| Viscosity index improver (Mw: 90,000) | 16.0 | 15.0 | 16.5 | — | 20.0 | 14.5 |
| Viscosity index improver (Mw ≧ 100,000) | — | — | — | 15.6 | — | — |
| Friction modifier (phosphate ester) | 0.5 | 0.5 | 0.5 | 0.5 | 0.5 | 0.5 |

TABLE I-continued

| | (Composition, wt. %) | | | | | |
|---|---|---|---|---|---|---|
| | Example 1 | Example 2 | Example 3 | Comparative Example 1 | Comparative Example 2 | Comparative Example 3 |
| Friction modifier (phosphite ester) | 0.5 | 0.5 | 0.5 | 0.5 | 0.5 | 0.5 |
| Properties | | | | | | |
| Kinematic viscosity (100° C. $mm^2/s$) | 6.2 | 6.2 | 6.2 | 7.0 | 7.0 | 6.2 |
| Viscosity index | 270 | 270 | 270 | 300 | 300 | 270 |
| Low-temperature viscosity (−40° C., mPa · s) | 1300 | 1350 | 1280 | 2500 | 3000 | 2300 |
| Evaporation loss (100° C. × 8 hr, wt. %) | 1.7 | 1.5 | 1.8 | 10.0 | 10.0 | 1.7 |
| Shear stability (100° C., %) (% viscosity reduction; 10 $KH_z$, 30 min.) | 6.2 | 5.6 | 6.3 | 13.0 | 7.0 | 5.4 |
| Compatibility with nitrile rubber | Good | Good | Good | Good | Good | Poor |

TABLE 2

| | (Composition, wt. %) | | | | | |
|---|---|---|---|---|---|---|
| | Example 4 | Example 5 | Example 6 | Example 7 | Example 8 | Example 9 |
| Base oil | | | | | | |
| PAO1 | — | — | 80 | 80 | — | — |
| PAO2 | 80 | 80 | — | — | 80 | 80 |
| Diester(DOA) | 20 | 20 | 20 | 20 | 20 | 20 |
| Mineral oil | — | — | — | — | — | — |
| Additive | | | | | | |
| Ashless dispersant | 0.2 | 0.2 | 0.2 | 0.2 | 0.2 | 0.2 |
| Antioxidant (phenol type) | 0.2 | 0.2 | 0.2 | 0.2 | 0.2 | 0.2 |
| Antioxidant (amine type) | 0.1 | 0.1 | 0.1 | 0.1 | 0.1 | 0.1 |
| Metal deactivator | 0.05 | 0.05 | 0.05 | 0.05 | 0.05 | 0.05 |
| Viscosity index improver (Mw: 35,000) | — | — | — | 17.0 | — | — |
| Viscosity index improver (Mw: 90,000) | 17.0 | 14.5 | 17.0 | — | 11.0 | 25.0 |
| Viscosity index improver (Mw ≧ 100,000) | — | — | — | — | — | — |
| Friction modifier (phosphate ester) | 0.5 | 0.5 | 0.5 | 0.5 | 0.5 | 0.5 |
| Friction modifier (phosphite ester) | 0.5 | 0.5 | 0.5 | 0.5 | 0.5 | 0.5 |
| Properties | | | | | | |
| Kinematic viscosity (100° C. $mm^2/s$) | 6.0 | 5.0 | 7.5 | 6.0 | 4.2 | 9.8 |
| Viscosity index | 305 | 300 | 280 | 270 | 290 | 330 |
| Low-temperature viscosity (−40° C., mPa · s) | 1000 | 700 | 1900 | 1550 | 550 | 1990 |
| Evaporation loss (100° C. × 8 hr, wt. %) | 1.7 | 1.7 | 1.5 | 1.5 | 1.7 | 1.7 |
| Shear stability (100° C., %) (% viscosity reduction; 10 $KH_z$, 30 min.) | 6.3 | 5.4 | 6.3 | 3.0 | 4.0 | 8.5 |
| Compatibility with nitrile rubber | Good | Good | Good | Good | Good | Good |

TABLE 3

| | (Composition, wt. %) | | | | | | |
|---|---|---|---|---|---|---|---|
| | Example 10 | Example 11 | Example 12 | Example 13 | Example 14 | Example 15 | Example 16 |
| Base oil | | | | | | | |
| PAO1 | 80 | 75 | 85 | — | — | — | — |
| PAO2 | — | — | — | 80 | 80 | 80 | 80 |
| Diester(DiDA) | 20 | 25 | 15 | 20 | 20 | 20 | 20 |
| Mineral oil | — | — | — | — | — | — | — |
| Additive | | | | | | | |
| Ashless dispersant | 0.2 | 0.2 | 0.2 | 0.2 | 0.2 | 0.2 | 0.2 |
| Antioxidant (phenol type) | 0.2 | 0.2 | 0.2 | 0.2 | 0.2 | 0.2 | 0.2 |
| Antioxidant (amine type) | 0.1 | 0.1 | 0.1 | 0.1 | 0.1 | 0.1 | 0.1 |
| Metal deactivator | 0.05 | 0.05 | 0.05 | 0.05 | 0.05 | 0.05 | 0.05 |
| Viscosity index improver (Mw: 90,000) | 13.0 | 13.0 | 13.0 | 16.0 | 13.0 | 9.0 | 24.0 |
| Friction modifier (phosphate ester) | 0.5 | 0.5 | 0.5 | 0.5 | 0.5 | 0.5 | 0.5 |
| Friction modifier (phosphite ester) | 0.5 | 0.5 | 0.5 | 0.5 | 0.5 | 0.5 | 0.5 |
| Properties | | | | | | | |
| Kinematic viscosity (100° C., $mm^2/s$) | 6.2 | 6.2 | 6.2 | 6.0 | 5.0 | 4.3 | 9.5 |
| Viscosity index | 255 | 255 | 255 | 300 | 290 | 275 | 320 |
| Low-temperature viscosity (−40° C., mPa · s) | 1550 | 1600 | 1570 | 1000 | 700 | 600 | 1900 |
| Evaporation loss (100° C. × 8 hr, wt. %) | 1.5 | 1.5 | 1.5 | 1.7 | 1.7 | 1.7 | 1.7 |
| Shear stability (100° C., %) (% viscosity reduction; 10 $KH_z$, 30 min.) | 5.0 | 5.0 | 5.0 | 6.0 | 5.0 | 4.0 | 8.0 |
| Compatibility with nitrile rubber | Good | Good | Good | Good | Good | Good | Good |

TABLE 4

| | (Composition, wt. %) | |
|---|---|---|
| | Example 17 | Example 18 |
| Base oil | | |

TABLE 4-continued

| | (Composition, wt. %) | |
|---|---|---|
| | Example 17 | Example 18 |
| PAO1 | 80 | 80 |

TABLE 4-continued

| (Composition, wt. %) | Example 17 | Example 18 |
|---|---|---|
| PAO2 | — | — |
| Diester(DOA) | 20 | 20 |
| Mineral oil | — | — |
| Additive | | |
| Ashless dispersant | 0.2 | 0.2 |
| Antioxidant (phenol type) | 0.2 | 0.2 |
| Antioxidant (amine type) | 0.1 | 0.1 |
| Metal deactivator | 0.05 | 0.05 |
| Viscosity index improver (Mw: 90,000) | 15.0 | 15.0 |
| Friction modifier (phosphate ester) | 0.5 | — |
| Friction modifier (phosphite ester) | — | 0.5 |
| Friction modifier (phosphoric ester amine salt) | 0.5 | 0.5 |
| Properties | | |
| Kinematic viscosity (100° C., $mm^2/s$) | 6.2 | 6.2 |
| Viscosity index | 270 | 268 |
| Low-temperature viscosity (−40° C., mPa · s) | 1400 | 1400 |
| Evaporation loss (100° C. × 8 hr, wt. %) | 1.5 | 1.5 |
| Shear stability (100° C., %) (% viscosity reduction; 10 $KH_z$, 30 min.) | 5.6 | 5.6 |
| Compatibility with nitrile rubber | Good | Good |

We claim:

1. A hydraulic fluid for automobile suspensions, said fluid having a kinematic viscosity of 4–10 $mm^2/s$ (=cSt) at 100° C. and a viscosity of 400–2,400 mPa.ss at −40° C. comprising:

(A) a base oil which comprises (a) 70 to 90 percent by weight of an olefin oligomer having a kinematic viscosity of 1.5–25 $mm^2/s$ at 100° C. and (b) 10 to 30 percent by weight of a diester obtained by condensation of an aliphatic dibasic acid having 4–14 carbon atoms and an alcohol having 4–14 carbon atoms and having a kinematic viscosity of 2–7 $mm^2/s$ at 100° C;

(B) 0.05 to 2 percent by weight on the basis of the total hydraulic fluid of a phosphate ester friction modifier selected from the group consisting of (1) isodecyl acid phosphate $(C_{10}H_{21}O)_2P(O)OH+C_{10}H_{21}OP(O)(OH)_2$, (2) tridecyl acid phosphate $(C_{13}H_{25}O)_2P(O)OH+C_{13}H_{25}OP(O)(OH)_2$, (3) isostearyl acid phosphate $(C_{18}H_{37}O)_2P(O)OH+C_{18}H_{37}OP(O)(OH)_2$ and (4) oleyl acid phosphate $(C_{18}H_{35}O)_2P(O)OH+C_{18}H_{35}OP(O)(OH)_2$ to improve the friction characteristics and antiwear characteristics in an initial stage;

(C) 0.5 to 2 percent by weight on the basis of the total hydraulic fluid of at least one friction modifier selected from the group consisting of dioleyl hydrogenphosphite $(C_{18}H_{35}O)_2P(OH)$ and phosphoric ester amine of the reaction product of $(i\text{-}C_8H_{17}O)_2P(OH)O$ and $(18\ H_{37})NH_2$ to retain low friction characteristics over a long period of time; and (D) 10 to 25 percent by weight on the basis of the total hydraulic fluid of a polymethacrylate viscosity index improver having a weight average molecular weight of at least 20,000 but lower than 100,000.

2. The hydraulic fluid for automobiles according to claim 1, wherein (A) the base oil comprises (a) 75–90 wt. % of said olefin oligomer and (b) 10–25 wt. % of said diester.

3. The hydraulic fluid for automobiles according to claim 2, wherein (A) the base oil comprises (a) 80–85 wt. % of said olefin oligomer, said olefin oligomer having an average molecular weight in the range of from about 100 to 2,000

(b) 15–20 wt. % of said diester, said diester having a kinematic viscosity of 2.2–6 $mm^2/s$ at 100° C.; and (D) said polymethacrylate viscosity index improver has a weight average molecular weight of 30,000–90,000.

4. The hydraulic fluid for automobiles according to claim 1, wherein said olefin oligomer of said base oil is a mixture of α-olefin oligomers having 6–12 carbon atoms.

5. The hydraulic fluid for automobiles according to claim 4, wherein said olefin oligomer of said base oil is obtained by a method comprising copolymerization of a mixture consisting of 25–50 wt. % of hexene-1, 30–40 wt. % of octene-1 and 25–40 wt. % of decene-1.

6. The hydraulic fluid for automobiles according to claim 4, wherein said olefin oligomer of said base oil is obtained by a method comprising copolymerization of 40–90 wt. % of ethylene and 10–60 wt. % of propylene.

7. The hydraulic fluid for automobiles according to claim 1, wherein said diester of said base oil is obtained by condensation of at least one aliphatic dibasic acid selected from the group consisting of adipic acid, azelaic acid and sebacic acid and at least one alcohol selected from the group consisting of 2-ethylhexanol and isodecanol.

8. A hydraulic fluid for automobile suspensions, said fluid having a kinematic viscosity of 4–10 $mm^2/s$ (=cSt) at 100° C. and a viscosity of 400–2,400 mPa.ss at −40° C. comprising:

(A) a base oil which comprises (a) 70 to 90 percent by weight of an olefin oligomer having a kinematic viscosity of 1.5–25 $mm^2/s$ at 100° C.; and (b) 10 to 30 percent by weight of a diester obtained by condensation of an aliphatic dibasic acid having 4–14 carbon atoms and an alcohol having 4–14 carbon atoms and having a kinematic viscosity of 2–7 $mm^2/s$ at 100° C.;

(B) 0.05 to 2 percent by weight on the basis of the total hydraulic fluid of a phosphate ester friction modifier comprising a mixture of $(C_{18}H_{35}O)P(OH)_2O$ and $(C_{18}H_{35}O)_2P(OH)O$ to improve the friction characteristics and antiwear characteristics in an initial stage;

(C) 0.5 to 2 percent by weight on the basis of the total hydraulic fluid of at least one friction modifier selected from the group consisting of $(C_{18}H_{35}O)_2P(OH)$ and diisooctyl acid phosphate oleyl amine salt to retain low friction characteristics over a long period of time; and (D) 10 to 25 percent by weight on the basis of the total hydraulic fluid of a polymethacrylate viscosity index improver having a weight average molecular weight of at least 20,000 but lower than 100,000.

* * * * *